US011022283B2

(12) United States Patent
Li

(10) Patent No.: US 11,022,283 B2
(45) Date of Patent: Jun. 1, 2021

(54) INTEGRATED RING CLIP OF FLASHLIGHT AND FLASHLIGHT

(71) Applicant: SYSMAX INNOVATIONS CO., LTD., Guangdong (CN)

(72) Inventor: Wenjie Li, Guangzhou (CN)

(73) Assignee: SYSMAX INNOVATIONS CO., LTD., Guangdong (CN)

( * ) Notice: Subject to any disclaimer, the term of this patent is extended or adjusted under 35 U.S.C. 154(b) by 42 days.

(21) Appl. No.: 16/542,704

(22) Filed: Aug. 16, 2019

(65) Prior Publication Data

US 2020/0208814 A1 Jul. 2, 2020

(30) Foreign Application Priority Data

Dec. 28, 2018 (CN) ..... 201822246662.3

(51) Int. Cl.

| | |
|---|---|
| ***F21V 21/088*** | (2006.01) |
| ***F21L 4/00*** | (2006.01) |
| ***F21S 9/02*** | (2006.01) |
| ***F21V 17/10*** | (2006.01) |

(Continued)

(52) U.S. Cl.

CPC ..... *F21V 21/0885* (2013.01); *F21L 4/005* (2013.01); *F21S 9/02* (2013.01); *F21V 17/10* (2013.01); *F21V 19/02* (2013.01); *F21V 33/00* (2013.01)

(58) Field of Classification Search

CPC ..... F21V 21/0885; F21V 17/10; F21V 19/02; F21V 33/00; F21L 4/005; F21S 9/02

See application file for complete search history.

(56) References Cited

U.S. PATENT DOCUMENTS

| | | | | |
|---|---|---|---|---|
| 5,460,346 | A | 10/1995 | Hirsch | |
| 2003/0000123 | A1* | 1/2003 | Phillips | F41C 27/00 42/85 |

(Continued)

FOREIGN PATENT DOCUMENTS

| | | | |
|---|---|---|---|
| CN | 202972555 | U | 6/2013 |
| CN | 203757652 | U | 8/2014 |
| CN | 205001888 | U | 1/2016 |

(Continued)

OTHER PUBLICATIONS

Extended European Search, European Application No. 19195383.5, dated Mar. 4, 2020, 10 pages.

*Primary Examiner* — Mary Ellen Bowman

(74) *Attorney, Agent, or Firm* — Nelson Mullins Riley & Scarborough LLP; Kongsik Kim, Esq.

(57) ABSTRACT

The present invention provides an integrated ring clamp of a flashlight, which includes a ring and a clip, wherein the ring has a base; the clip includes a clamping part and a holding part that can hold and be fixed to a body of the flashlight, the holding part is fixed to the clamping part, and the clamping part is detachably fixed to the base. The present invention also provides a flashlight, which includes a flashlight body and the integrated ring clip, and may further include a flashlight sleeve sleeved on the outer face of the flashlight body and wrapping the same. The integrated ring clamp and the flashlight solve the problem of a structural conflict of the ring and the clip, so that the ring and the clip can be present on the flashlight at the same time, thereby achieving diversified functions.

23 Claims, 13 Drawing Sheets

(51) Int. Cl.
*F21V 19/02* (2006.01)
*F21V 33/00* (2006.01)

(56) References Cited

U.S. PATENT DOCUMENTS

2004/0252494 A1 12/2004 Parsons et al.
2017/0284646 A1* 10/2017 Arena ..... F21V 23/0414

FOREIGN PATENT DOCUMENTS

CN 207731848 U 2/2018
CN 207213706 U 4/2018
CN 207486509 U 6/2018
CN 207501094 U 6/2018
GB 304824 A 1/1929

* cited by examiner

INTEGRATED RING CLIP OF FLASHLIGHT AND FLASHLIGHT

CROSS-REFERENCE TO RELATED APPLICATIONS

This application claims priority to Chinese Application No. CN 201822246662.3 having a filing date of Dec. 28, 2018, the entire contents of which are hereby incorporated by reference.

FIELD OF TECHNOLOGY

The invention relates to the technical field of flashlights, in particular to an integrated ring clip of a flashlight and a flashlight.

BACKGROUND

Some flashlights in the prior include a ring, which is generally sleeved on the body of the flashlight, with a finger lock as a closed ring structure to facilitate gripping by a user; and some flashlights include a clip, which is also fixed to the body of the flashlight, for fixing the flashlight to a belt or an edge of a pocket. However, due to the structure and effect of the ring and the clip and the space in the flashlight cylinder body occupied thereby, they are generally not mounted to the flashlight at the same time, and when the user needs functions of them at the same time, the demand cannot be satisfied.

SUMMARY

In view of this, an objective of the invention is providing an integrated ring clip of a flashlight, which solves the problem of a structural conflict of the ring and the clip, so that the ring and the clip can be present on the flashlight at the same time, thereby achieving diversified functions.

A technical solution adopted in the invention is as follows:

An integrated ring clamp of a flashlight includes a ring and a clip, wherein the ring has a base; the clip includes a clamping part and a holding part that can hold and be fixed to a body of the flashlight, the holding part being fixed to the clamping part, and the clamping part being detachably fixed to the base.

Further, the clamping part includes a first clamping arm, a second clamping arm and a transition part, wherein the first clamping arm and the second clamping arm are connected through the transition part; the first clamping arm is detachably fixed to the base; and the second clamping arm is fixed to the top of the holding part.

As an embodiment, the first clamping arm includes an arm body and a buckle, wherein the buckle is an elastic sheet with one end fixed to the arm body and the other end located above the arm body; the bottom face of the base is provided with a first clamping slot, running through in the front-rear direction, configured to clamp the first clamping arm, and the bottom face of the first clamping slot is provided with a second clamping slot for accommodating and clamping the buckle.

As an embodiment, the arm body is provided with a through hole, and one end of the buckle is connected to an edge of the through hole, and the other end thereof is a free end located above the through hole.

Further, the base includes a left clamping part and a right clamping part, wherein the left clamping part and the right clamping part each include a supporting part that can support the first clamping arm and limit the first clamping arm in the left-right direction, and a limiting part that can limit the first clamping part from moving backward, the supporting part and the limiting part being arranged successively in the front-rear direction; the second clamping slot is recessed obliquely forward from the bottom face of the first clamping slot, and has an oblique bottom face; and the oblique bottom face of the second clamping slot corresponds to the buckle of the first clamping arm.

Further, each supporting part includes a first side wall and a first support body horizontally extending inward from the end of the first side wall, and the supporting part of the left clamping part and the supporting part of the right clamping part enclose a T-shaped groove therebetween; each limiting part includes a second support body and a limiting body, the second support body extending rearward from the first support body, and the limiting body extending upward from the second support body to the bottom face of the first clamping slot; the limiting part of the left clamping part and the limiting part of the right clamping part enclose a groove therebetween, the opening width of the groove being equal to that of bottom of the T-shaped groove, and the T-shaped groove being communicated with the groove to form the first clamping slot.

Further, the arm body of the first clamping arm is a flat and straight sheet, and includes a base part and two first protruding parts, wherein the first protruding parts are connected to two sides of the base part respectively and extend outward along the width direction of the base part; the rear end of each first protruding part abuts against one of the limiting bodies; and the maximum width of the arm body is greater than the opening width of bottom of the T-shaped groove, but not greater than the top width of the T-shaped groove.

As an embodiment, the left clamping part and/or the right clamping part is also provided with an anti-collision groove.

Preferably, the transition part is bent, and the second clamping arm is located just below the first clamping arm, and a clamping space is formed between the base of the ring and the second clamping arm.

Further, the holding part is composed of two holding bodies located on the left side and the right side of the second clamping arm respectively, and each holding part is a bent elastic sheet.

The invention also provides a flashlight, including a flashlight body and the integrated ring clip of the flashlight. The flashlight body includes a flashlight cylinder body, the flashlight cylinder body being provided with a connecting groove arranged on the outer face thereof around the flashlight cylinder body, and the holding part of the integrated ring clip holds and is fixed to the flashlight cylinder body and is limited within the connecting groove.

Preferably, the flashlight body further includes a cylinder tail assembly, a battery and a cylinder head, wherein the cylinder tail assembly includes a cylinder tail, a first PCB, a tactical switch, a tact switch and a switch pressing plate; the cylinder tail includes a cylinder wall and a cover that covers the top of the cylinder wall; the cover is step-like and formed by a first cover and a second cover connected from high to low; the second cover, the cylinder wall and the first cover enclose an accommodating cavity; the first cover is provided with a first through hole, and the second cover is provided with a second through hole; the first PCB is located inside the cylinder wall of the cylinder tail; the tactical switch and the tact switch are electrically connected and fixed to the first PCB respectively; the tactical switch passes through the first through hole and protrudes from the first cover; the tact switch passes through the second through hole and protrudes from the second cover, and is located within the accommodating cavity; the switch pressing plate is rotatably arranged above the tact switch, and the top face of the switch pressing plate is not higher than the first cover; and when the switch pressing plate is pressed, the tact switch is triggered.

In the preferred technical solution described above, as compared with the prior art, the structural position for operating the tact switch is also improved. The existing flashlight can only be provided with a tactical switch with an on/off function at the tail. Although both a tactical switch and a tact switch are provided at the tail later (as shown in FIGS. 11-12), wherein the tactical switch is operated to control the on and off of a power supply, and the tact switch is operated for dimming, however, as both switches are actually designed to be operated with one hand, the space of the flashlight tail is narrow, the contact areas of the tactical switch and the tact switch on the crowded end face are relatively small, which causes inconvenience in operation, and when one switch is operated, the other switch may be touched mistakenly. Whereas in the technical solution described above, the switch pressing plate is located in the cylinder tail, instead of conventionally placing the switch pressing plate of the tact switch above the cylinder tail, thus avoiding the mistaken touch during use by a user in the case where the two switches are both located at the cylinder tail. As a specific embodiment, two sides of the switch pressing plate are rotatably fixed to the cylinder wall through pins.

As a specific embodiment, the flashlight body also includes a switch bracket and a silicone button cover; the tact switch includes a switch part and a button part; the switch part of the tact switch is electrically connected and fixed to the first PCB, and the button part is located above the switch part; the switch bracket is provided with a third through hole and a fourth through hole; the switch bracket is sleeved on the first PCB; the tactical switch passes through the third through hole and the first through hole successively and protrudes from the first cover; the button part of the tact switch passes through the fourth through hole and the second through hole successively, protrudes from the second cover, and is located within the accommodating cavity; the silicone button cover includes a silicone button cap located above the tactical switch and a silicone button cap located above the button part of the tact switch; the silicone button cap of the tactical switch passes through the first through hole and protrudes from the first cover; the silicone button cap of the tact switch passes through the second through hole, protrudes from the second cover, and is located within the accommodating cavity; and the switch pressing plate is rotatably arranged above the silicone button cap of the tact switch.

As an embodiment, the cylinder tail assembly also includes a cylinder tail adapter tube, and the cylinder tail adapter tube includes a tube body, a second PCB fixed to the interior of the tube body, and a spring connected to the bottom of the second PCB, wherein the tube body is connected to the lower side of the cylinder tail, and the second PCB is electrically connected with the first PCB.

Further, the flashlight further includes a flashlight sleeve sleeved on the outer face of the flashlight body and wrapping the same, the flashlight sleeve includes a flashlight sleeve body, an opening part, and a first cantilever and a second cantilever, which are arranged symmetrically, for clamping the flashlight body, wherein the opening part is formed at the flashlight sleeve body and extends in the up-down direction from the top to the bottom of the flashlight sleeve body.

The opening part of the flashlight described above is a specific configuration of the integrated ring clip of the invention, and is applicable to a flashlight using the integrated ring clip of the invention.

As an embodiment, the flashlight sleeve body is provided with two fifth through holes, and the first cantilever and the second cantilever are elastic sheets located in the two fifth through holes respectively, and each includes a second protruding part protruding from the inner wall of the flashlight sleeve body respectively, one ends of the first cantilever and the second cantilever being fixed to the flashlight sleeve body, and the other ends thereof being free ends.

Preferably, the flashlight sleeve body includes a second groove formed at a bottom position of the flashlight sleeve body and extending along the circumferential direction of the outer face of the flashlight sleeve body.

As an embodiment, the opening part includes a first opening part and a second opening part which are connected in the up-down direction, and the opening width of the first opening part is greater than that of the second opening part. In this way, a position is provided for the integrated ring clip of the invention; moreover, at the bottom, the flashlight sleeve is more tightly sleeved to the flashlight body and prevented from sliding off.

The invention has the following beneficial effects:

(1) The integrated ring clip of the flashlight of the invention is simple in structure and space-saving, and solves the problem of a structural conflict of the ring and the clip, so that the ring and the clip are integrated and can be present on the flashlight at the same time, thereby achieving diversified functions.

(2) For the flashlight of the invention, as it includes the integrated ring clip, which facilitates military use, and can be fixed to a belt or pocket of the user, and when using the flashlight, the user can operate it with a single hand, a middle finger of one hand passing through the ring (see FIG. 9 for the using scenario), using a joint at the root of the thumb to trigger the tactical switch at the tail, thereby being convenient and labor-saving in use, and the hand can be used together with the other hand at the same time to operate a gun (see FIG. 10 for the using scenario).

(3) For the flashlight of the invention, the positions and relative positions of the tactical switch and the tact switch may also be improved, so that mistaken switch touch does not occur during use with one hand.

(4) The flashlight of the invention may also be used with the specific flashlight sleeve, which is compatible with the integrated ring clip of the invention.

Figure 1:
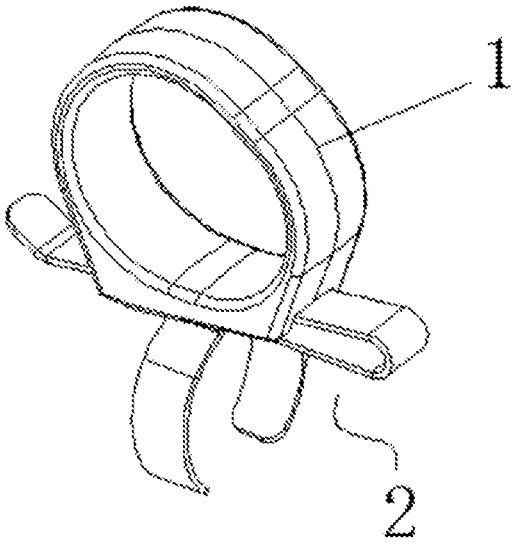
FIG. 1 is a three-dimensional structure diagram of an integrated ring clip of a flashlight of Embodiment 1.
Figure 2:
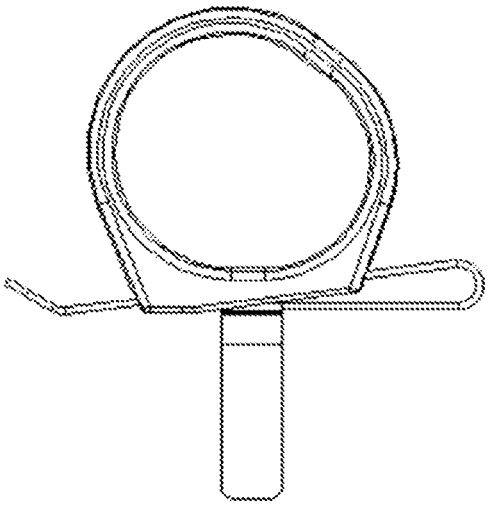
FIG. 2 is a front view of the integrated ring clip of the flashlight of Embodiment 1.
Figure 3:
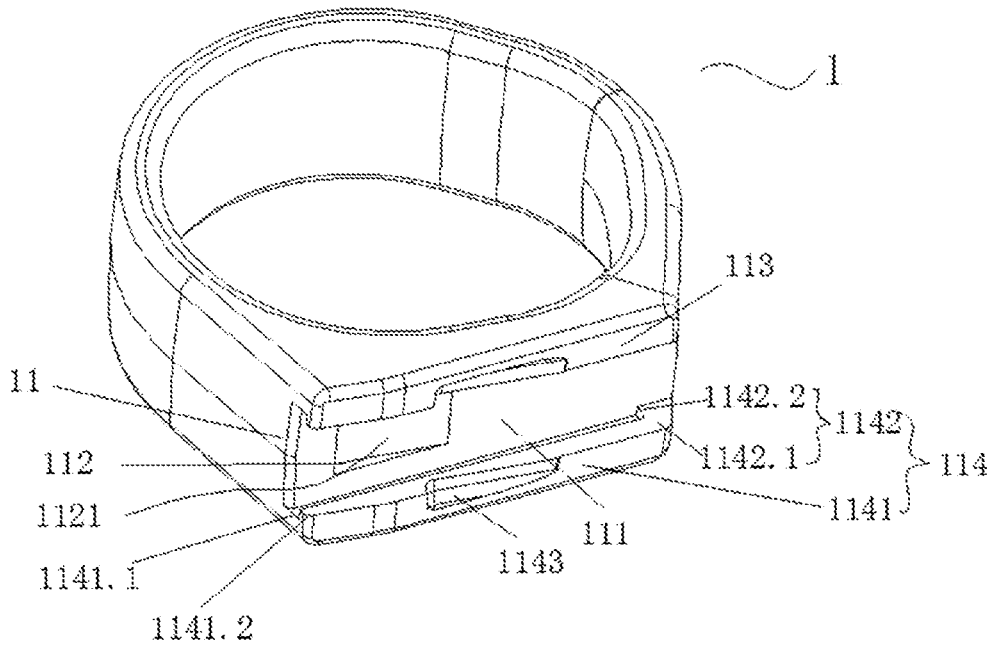
FIG. 3 is a three-dimensional structure diagram of a ring of the integrated ring clip of the flashlight of Embodiment 1.
Figure 4:
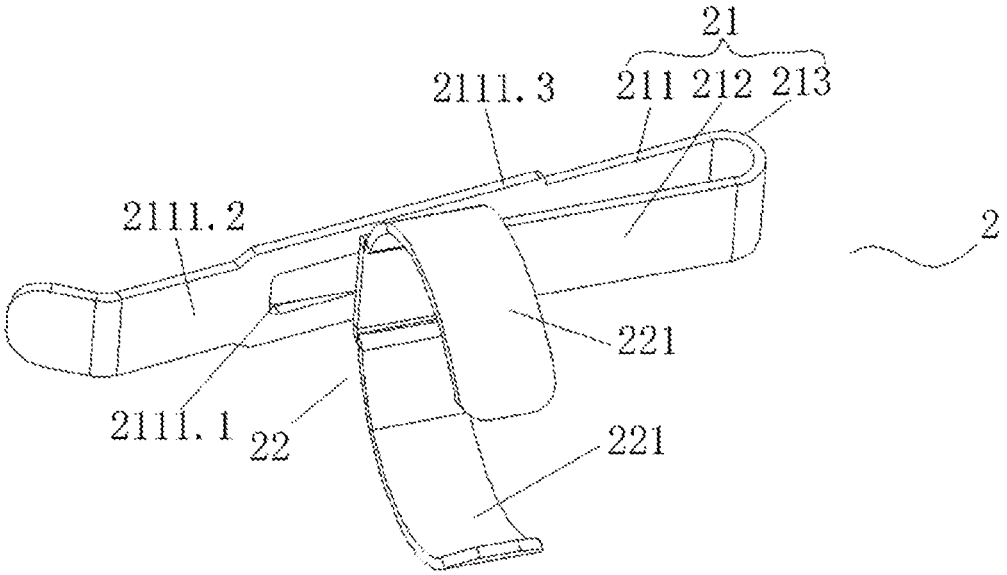
FIG. 4 is a three-dimensional structure diagram of a clip of the integrated ring clip of the flashlight of Embodiment 1.
Figure 5:
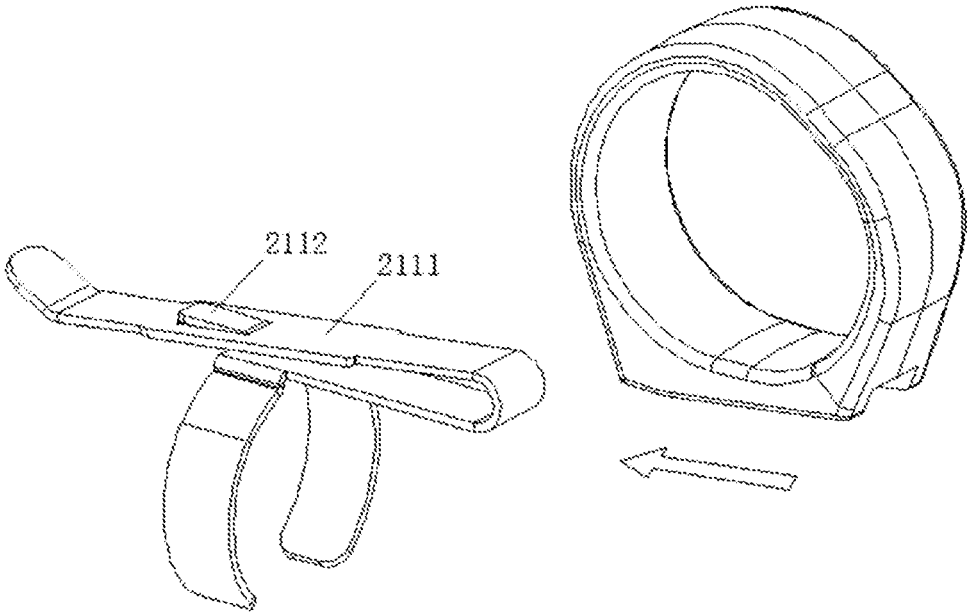
FIG. 5 is a schematic diagram of a mounting method of the ring and the clip of the integrated ring clip of the flashlight of Embodiment 1.
Figure 6:
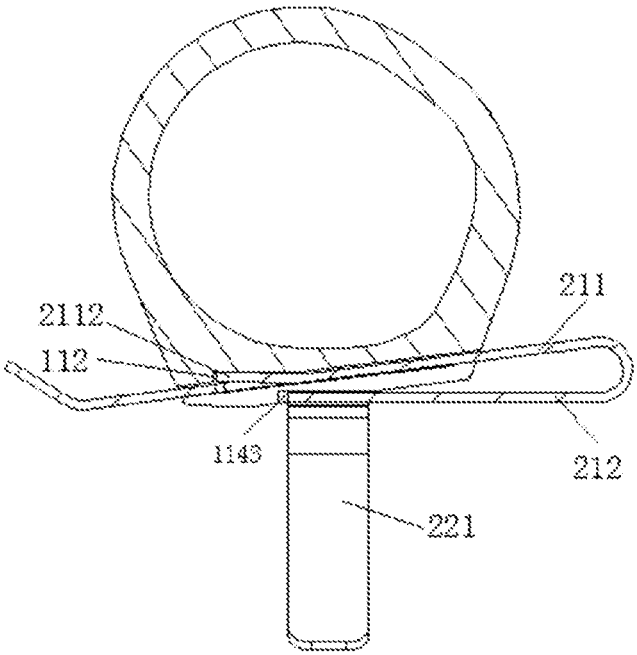
FIG. 6 is a sectional diagram of the integrated ring clip of the flashlight of Embodiment 1.

Reference numerals: 1—ring, 11—base, 111—first clamping slot, 112—second clamping slot, 1121—oblique bottom face, 113—left clamping part, 114—right clamping part, 1141—supporting part, 1141.1—first side wall, 1141.2—first support body, 1142—limiting part, 1142.1—second support body, 1142.2—limiting body, 1143—anti-collision groove, 2—clip, 21—clamping part, 211—first clamping arm, 2111—arm body, 2111.1—through hole, 2111.2—base part, 2111.3—first protruding part, 2112—buckle, 212—second clamping arm, 213—transition part, 22—holding part, 221—holding body, 3—flashlight body, 31—flashlight cylinder body, 311—connecting groove, 32—cylinder tail assembly, 321—cylinder tail, 3211—cylinder wall, 3212—cover, 3212.1—first cover, 3212.11—first through hole, 3212.2—second cover, 3212.21—second through hole, 322—first PCB, 323—tactical switch, 324—tact switch, 3241—switch part, 3242—button part, 325—pin, 326—switch bracket, 3261—third through hole, 3262—fourth through hole, 327—silicone button cover, 3271—silicone button cap, 3272—silicone button cap, 328—switch pressing plate, 329—cylinder tail adapter tube, 3291—tube body, 3292—second PCB, 3293—spring, 3294—spring washer, 33—battery, 34—cylinder head, 4—flashlight sleeve, 41—flashlight sleeve body, 411—fifth through hole, 412—second groove, 42—opening part, 421—first opening part, 422—second opening part, 43—first cantilever, 431—second protruding part, 44—second cantilever, 441—second protruding part.

DETAILED DESCRIPTION

Embodiment 1

As shown in FIGS. 1-6, an integrated ring clamp of a flashlight of the embodiment includes a ring 1 and a clip 2, wherein the ring 1 has a base 11; the clip 2 includes a clamping part 21 and a holding part 22 that can hold and be fixed to a cylinder body of the flashlight, the holding part 22 being fixed to the clamping part 21, and the clamping part 21 being detachably fixed to the base 11. As the clamping part 21 is detachably fixed to the base 11, the ring 1 and the clip 2 are integrated and coexist on the flashlight.

As a specific embodiment, the clamping part 21 includes a first clamping arm 211, a second clamping arm 212 and a transition part 213, wherein the first clamping arm 211 and the second clamping arm 212 are connected through the transition part 213; the first clamping arm 211 is detachably fixed to the base 11; and the second clamping arm 212 is fixed to the top of the holding part 22. That is, the first clamping arm 211 is connected to the holding part 22 through the second clamping arm 212, so that the clip 2 can be detachably connected to the ring 1 while being fixed to the flashlight cylinder body. Of course, in other embodiments, the clip may also adopt other structural design to achieve the purpose of connection to both the flashlight cylinder body and the ring.

Further, as an embodiment, the first clamping arm 211 includes an arm body 2111 and a buckle 2112, wherein the buckle 2112 is an elastic sheet with one end fixed to the arm body 2111 and the other end located above the arm body 2111; the bottom face of the base 11 is provided with a first clamping slot 111, running through in the front-rear direction, configured to clamp the first clamping arm 211, and the bottom face of the first clamping slot 111 is provided with a second clamping slot 112 for accommodating and clamping the buckle 2112. In other embodiments, the purpose of detachable connection may also be achieved by other structural features of the holding part and the base of the ring.

In an embodiment, the arm body 2111 may be provided with a through hole 2111.1, and one end of the buckle 2112 is connected to an edge of the through hole 2111.1, and the other end thereof is a free end located above the through hole 2111.1.

Further, as a specific embodiment, the base 11 includes a left clamping part 113 and a right clamping part 114, wherein the left clamping part 113 and the right clamping part 114 (using the right clamping part 114 as an example) each include a supporting part 1141 that can support the first clamping arm 211 and limit the first clamping arm 211 in the left-right direction, and a limiting part 1142 that can limit the first clamping part 211 from moving backward, the supporting part 1141 and the limiting part 1142 being arranged successively in the front-rear direction; the second clamping slot 112 is recessed obliquely forward from the bottom face of the first clamping slot 111, and has an oblique bottom face 1121; and the oblique bottom face 1121 of the second clamping slot 112 corresponds to the buckle 2112 of the first clamping arm 211. With such specific structural configuration on the base 11, the first clamping arm 211 is limited on the base 11 in the up-down, front-rear, and left-right directions.

Specifically, using the right clamping part 114 as an example, each supporting part may further include a first side wall 1141.1 and a first support body 1141.2 horizontally extending inward from the end of the first side wall 1141.1, and the supporting part of the left clamping part 113 and the supporting part 1141 of the right clamping part 114 enclose a T-shaped groove therebetween; using the right clamping part 114 as an example, each limiting part includes a second support body 1142.1 and a limiting body 1142.2, the second support body 1142.1 extending rearward from the first support body 1141.2, and the limiting body 1142.2 extending upward from the second support body 1142.1 to the bottom face of the first clamping slot 111; the limiting part of the left clamping part 113 and the limiting part 1142 of the right clamping part 114 enclose a groove therebetween, the opening width of the groove being equal to that of bottom of the T-shaped groove, and the T-shaped groove being communicated with the groove to form the first clamping slot 111. The arm body 2111 of the first clamping arm 211 can be a flat and straight sheet, and can include a base part 2111.2 and two first protruding parts 2111.3, wherein the first protruding parts 2111.3 are connected to two sides of the base part 2111.2 respectively and extend outward along the width direction of the base part 2111.2; the rear ends of the first protruding parts 2111.3 abut against the limiting bodies respectively; and the maximum width of the arm body 2111 is greater than the opening width of bottom of the T-shaped groove, but not greater than the top width of the T-shaped groove. Described above is a specific embodiment, in which with the specific structures of the first clamping slot 111, the left clamping part 113, the right clamping part 114 and the first clamping arm 211, when the ring 1 is moved toward the first clamping arm 211 along the direction indicated by the arrow of FIG. 5, the first clamping arm 211 slides in the first clamping slot 111, the first protruding parts 2111.3 are lifted up by the first support bodies 1141.2, and the first clamping arm 211 is limited within the T-shaped groove in the up-down and left-right directions; and when the rear ends of the first protruding parts 2111.3 abut against the limiting bodies respectively, the first clamping arm 211 no longer slides rearward, and its buckle 2112 is clicked into the second clamping slot 112, so that the first clamping arm 211 is fixed to the ring 1, and the first clamping arm 211 cannot slide forward. In other embodiments, the first clamping arm may also be limited and fixed to the base of the ring by other structure configuration. As a preferred embodiment, the left clamping part and the right clamping part can be arranged in a left-right symmetrical manner.

Further, when the first clamping arm 211 is fixed to the base 11 of the ring 1, the top of the holding part 22 may collide with the left clamping part 113 and/or the right clamping part 114, and thus as an embodiment, the left clamping part 113 and/or the right clamping part 114 may also be provided with an anti-collision groove 1143 (using the right clamping part 114 as an example).

As a preferred embodiment, the transition part 213 is bent, and the second clamping arm 212 is located just below the first clamping arm 211, and a clamping space is formed between the base 11 of the ring 1 and the second clamping arm 212. In this way, the space of the flashlight can be saved. Of course, in other embodiments, the second clamping arm and the first clamping arm may also have other mutual positional relation.

Specifically, as an embodiment, the holding part 22 can be composed of two holding bodies 221 located on the left side and the right side of the second clamping arm 212 respectively, and each holding body 221 is a bent elastic sheet. As a preferred embodiment, the two holding bodies 221 can be located on a same cylinder or cylinder-like body.

Embodiment 2

Figure 7:
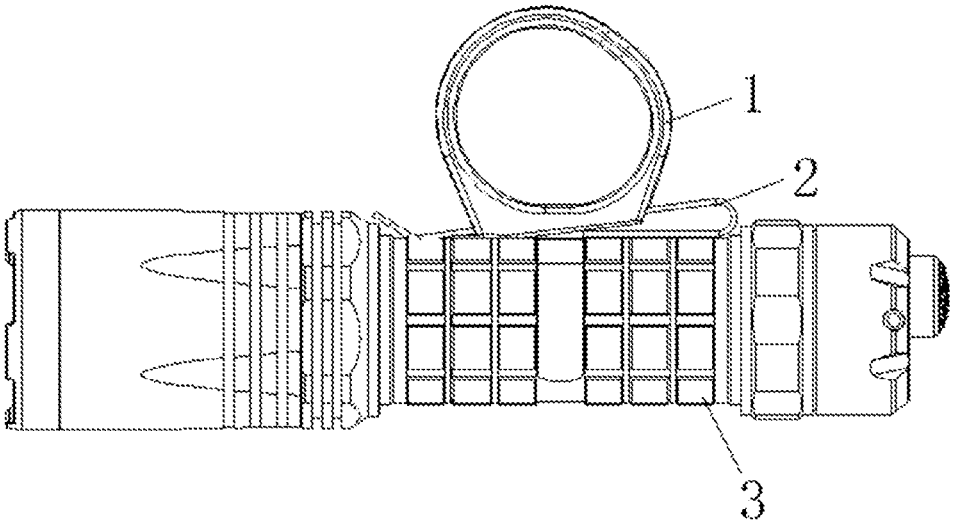
FIG. 7 is a sectional diagram of an installation state of a flashlight of Embodiment 2.
Figure 8:
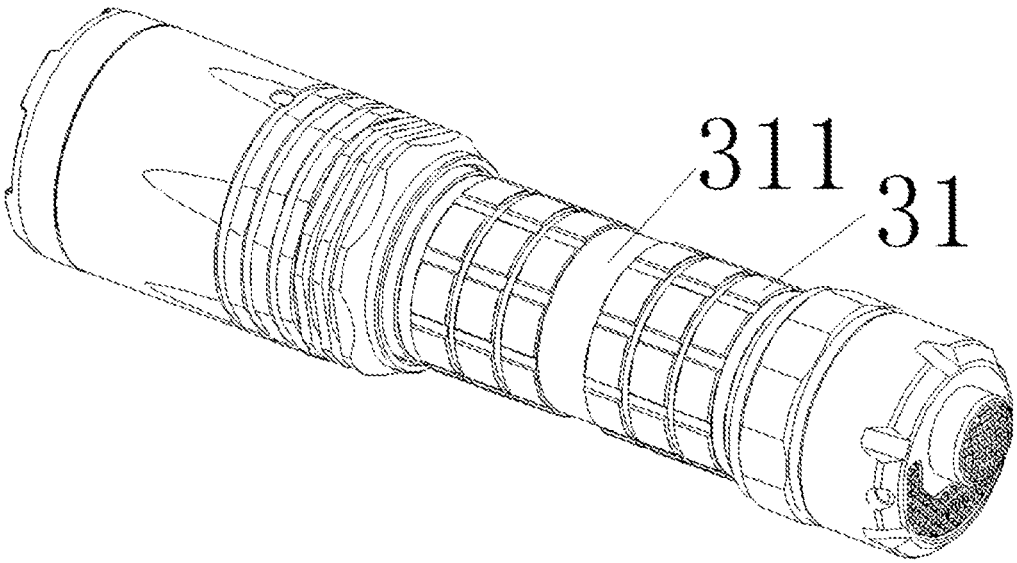
FIG. 8 is a three-dimensional structure diagram of a flashlight body of Embodiment 2.
Figure 9:
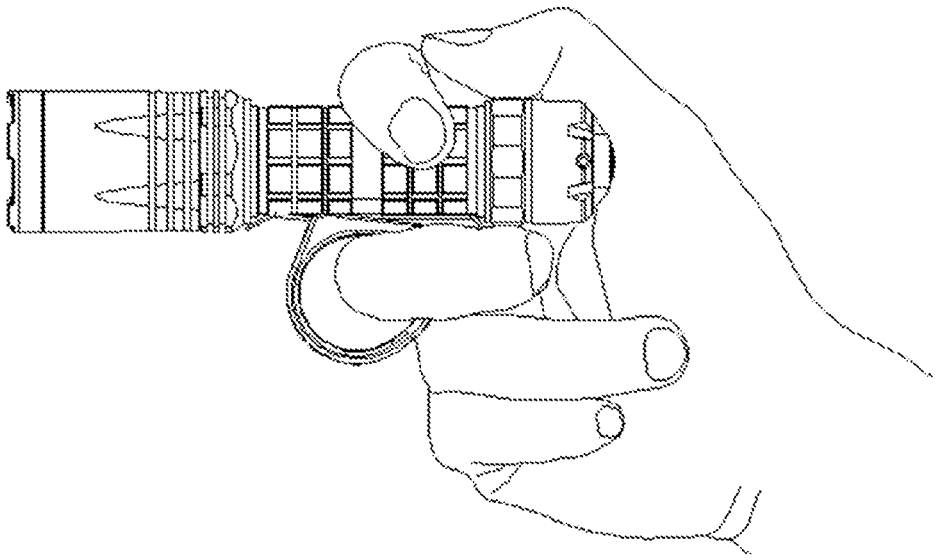
FIG. 9 is a schematic diagram of the flashlight of Embodiment 2 in a using scenario I.
Figure 10:
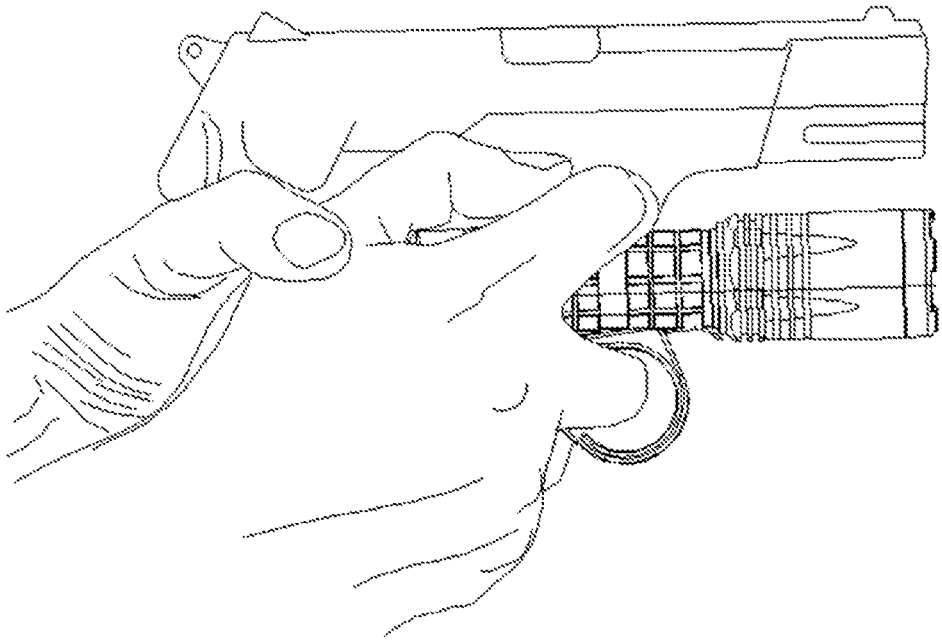
FIG. 10 is a schematic diagram of the flashlight of Embodiment 2 in a using scenario II.

As shown in FIGS. 7-8, the flashlight of the embodiment includes a flashlight body 3 and the integrated ring clip of the flashlight described in the invention. The flashlight body 3 includes a flashlight cylinder body 31, the flashlight cylinder body 31 being provided with a connecting groove 311 arranged on the outer face thereof around the flashlight cylinder body 31, and the holding part 22 of the integrated ring clip of the invention holds and is fixed to the flashlight cylinder body 31 and is limited within the connecting groove 311. FIGS. 9-10 show state diagrams of the flashlight of the embodiment in two different usage scenarios.

Embodiment 3

As shown in FIGS. 13-16, for the flashlight of the embodiment, based on Embodiment 2, the flashlight body 3 further includes a cylinder tail assembly 32, a battery 32 and a cylinder head 34, wherein the cylinder tail assembly 32 includes a cylinder tail 321, a first PCB 322, a tactical switch 323, a tact switch 324 and a switch pressing plate 328; the cylinder tail 321 includes a cylinder wall 3211 and a cover 3212 that covers the top of the cylinder wall 3211; the cover 3212 is step-like and formed by a first cover 3212.1 and a second cover 3212.2 connected from high to low; the second cover 3212.2, the cylinder wall 3211 and the first cover 3212.1 enclose an accommodating cavity; the first cover 3212.1 is provided with a first through hole 3212.11, and the second cover 3212.2 is provided with a second through hole 3212.21; the first PCB 322 is located inside the cylinder wall 3211 of the cylinder tail 321; the tactical switch 323 and the tact switch 324 are electrically connected and fixed to the first PCB 322 respectively; the tactical switch 323 passes through the first through hole 3212.11 and protrudes from the first cover 3212.1; the tact switch 324 passes through the second through hole 3212.21 and protrudes from the second cover 3212.2, and is located within the accommodating cavity; the switch pressing plate 328 is rotatably arranged above the tact switch 324, and the top face of the switch pressing plate is not higher than the first cover 3212.1; and when the switch pressing plate 328 is pressed, the tact switch 324 is triggered.

As the switch pressing plate is located within the accommodating cavity, only when the switch pressing plate is pressed, can the tact switch be triggered, and if a user operates the flashlight with one hand, he is not liable to touch the tact switch when pressing the tactical switch, and mistakenly touching the tact switch is not likely to occur.

As a specific embodiment, the flashlight body 3 may also include a switch bracket 326 and a silicone button cover 327; the tact switch 324 includes a switch part 3241 and a button part 3242; the switch part 3241 of the tact switch 324 is electrically connected and fixed to the first PCB 322, and the button part 3242 is located above the switch part 3241; the switch bracket 326 is provided with a third through hole 3261 and a fourth through hole 3262; the switch bracket 326 is sleeved on the first PCB 322; the tactical switch 323 passes through the third through hole 3261 and the first through hole 3212.11 successively and protrudes from the first cover 3212.1; the button part 3242 of the tact switch 324 passes through the fourth through hole 3262 and the second through hole 3212.21 successively, protrudes from the second cover 3212.2, and is located within the accommodating cavity; the silicone button cover 327 includes a silicone button cap 3271 located above the tactical switch 323 and a silicone button cap 3272 located above the button part 3242 of the tact switch 324; the silicone button cap 3271 above the tactical switch 323 passes through the first through hole 3212.11 and protrudes from the first cover 3212.1; the silicone button cap 3272 above the tact switch 324 passes through the second through hole 3212.21, protrudes from the second cover 3212.2, and is located within the accommodating cavity; and the switch pressing plate 328 is rotatably arranged above the silicone button cap 3272 of the tact switch 324.

With the specific cylinder tail structural configuration described above, the flashlight has the following working principles:

(1) When the switch pressing plate is pressed by an external force, that is, through the switch pressing plate→the silicone button cap→the button part of the tact switch→the tact switch, a dimming mode is achieved; and (2) when the tactical switch is pressed by an external force, that is, through the silicone button cap→the tactical switch, a power on/off mode is achieved.

Figure 11:
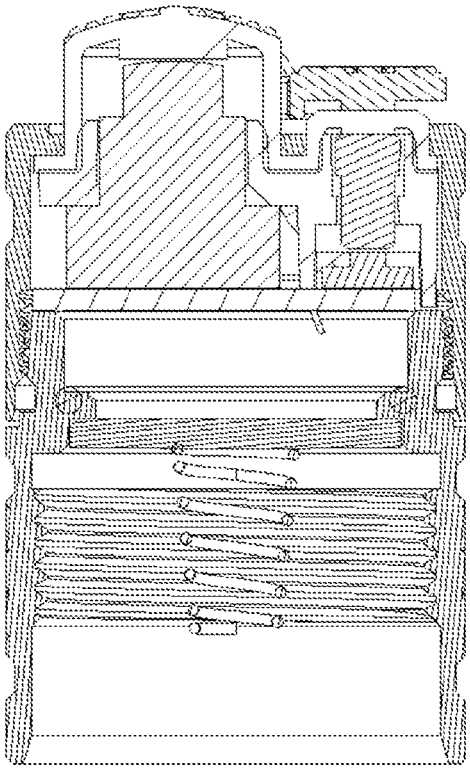
FIG. 11 is a sectional structure diagram of a cylinder tail assembly of a flashlight body in the prior art.
Figure 12:
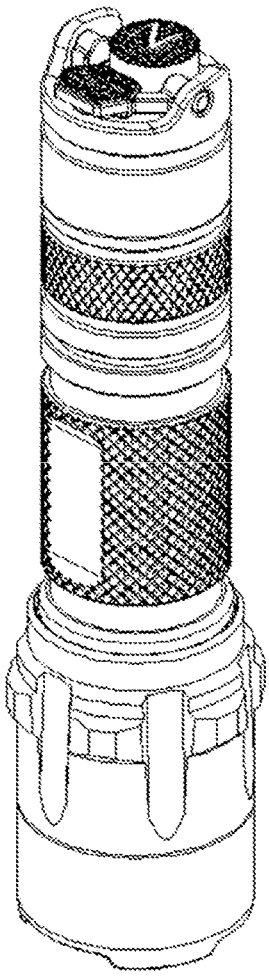
FIG. 12 is a three-dimensional structure diagram of the flashlight body in the prior art.
Figure 13:
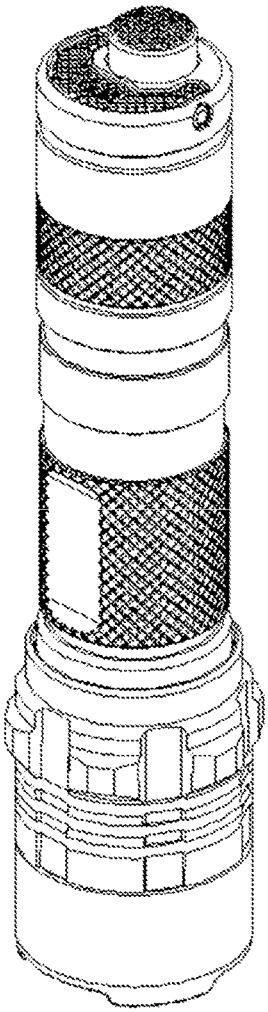
FIG. 13 is a three-dimensional structure diagram of a flashlight body of Embodiment 3.
Figure 14:
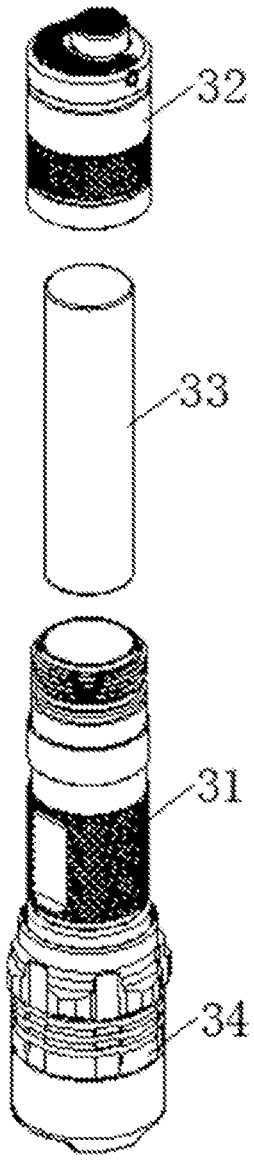
FIG. 14 is an exploded diagram of various parts of the flashlight body of Embodiment 3.
Figure 15:
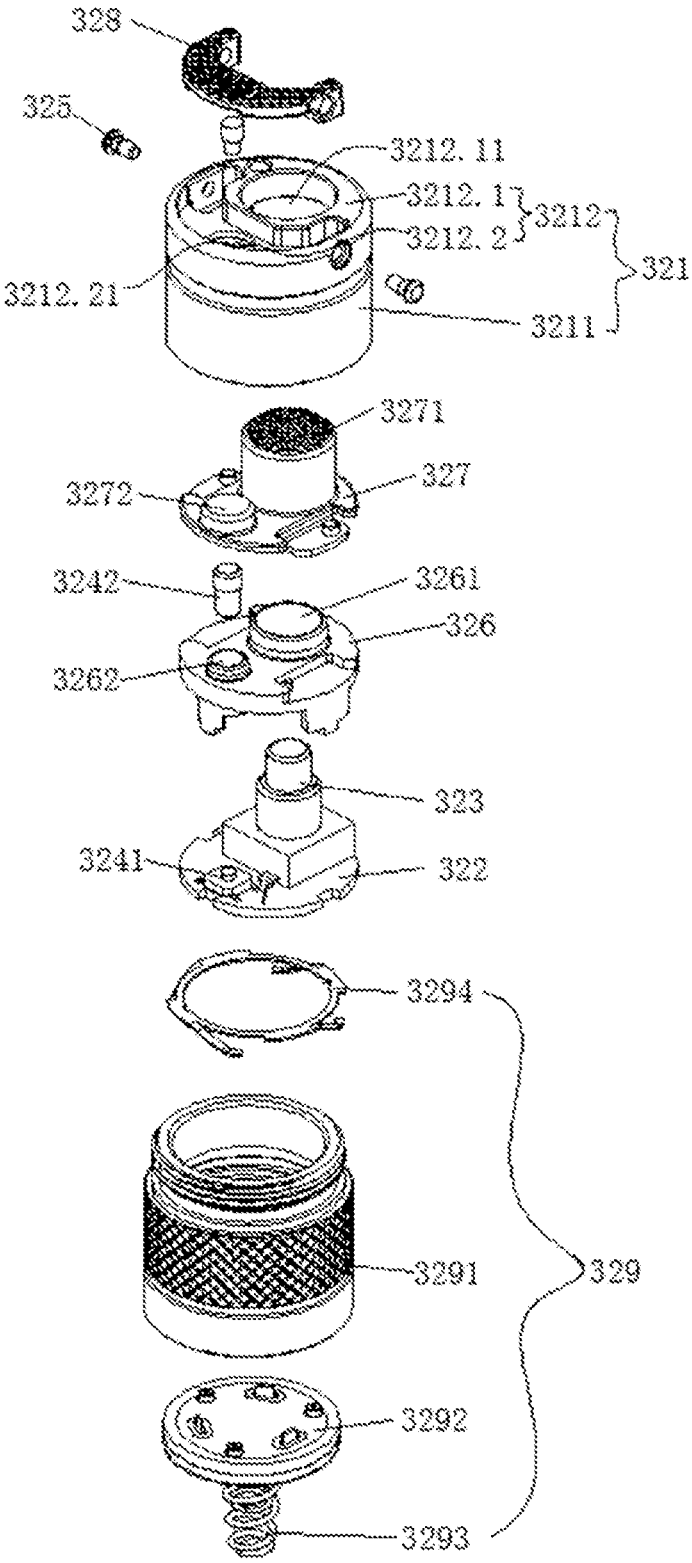
FIG. 15 is an exploded structure diagram of a cylinder tail assembly of the flashlight body of Embodiment 3.
Figure 16:
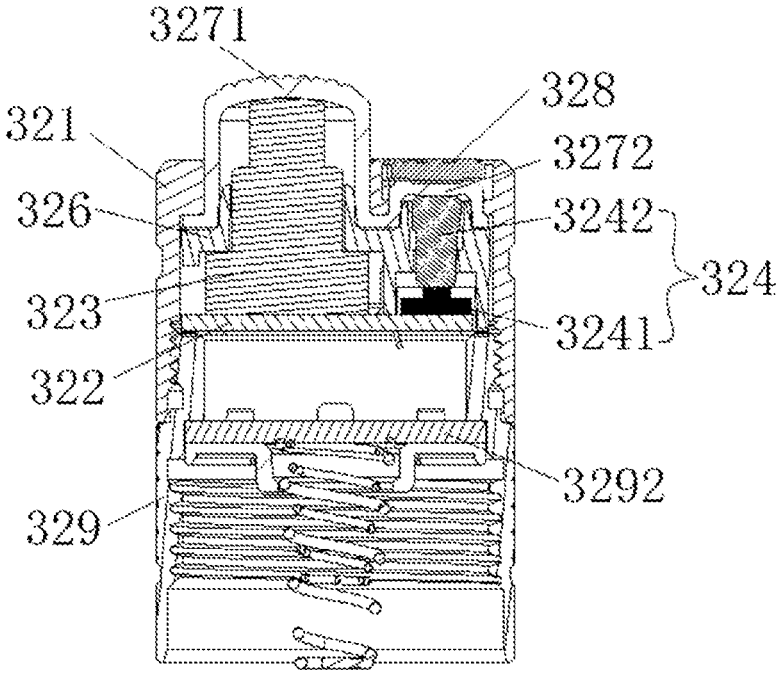
FIG. 16 is a sectional structure diagram of the cylinder tail assembly of the flashlight body of Embodiment 3.

To enter the dimming mode, the switch pressing plate 328 needs to be pressed to trigger the tact switch 324, and as the top face of the switch pressing plate 328 is not higher than the first cover 3212.1, when the integrated ring clip of the invention is used and the tactical switch 323 is pressed through operation with one hand, the tact switch is not touched mistakenly due to the action of a finger. As shown in FIGS. 11-12, silicone button caps of a tactical switch and a tact switch in the prior art are both located above a first cover, and the tact switch may be touched mistakenly when the tactical switch is operated.

As an embodiment, two sides of the switch pressing plate 328 are rotatably fixed to the cylinder wall 3211 through pins 325, specifically: the two pins 325 are fit to the cylinder tail in a fastened manner, and fit to the switch pressing plate 328 in a loose manner, such that the switch pressing plate 328 can rotate about the pins 325 as shafts. In other embodiments, the switch pressing plate may also be rotatably fixed to the cylinder wall in other manners.

Further, the cylinder tail assembly 32 may also include a cylinder tail adapter tube 329, and the cylinder tail adapter tube 329 includes a tube body 3291, a second PCB 3292 fixed to the interior of the tube body 3291, and a spring 3293 connected to the bottom of the second PCB 3292, wherein the tube body 3291 is connected to the lower side of the cylinder tail 321 (for example, the cylinder tail 321 may be provided with internal threads, and the tube body 3291 may be provided with external threads, the internal threads and the external threads being connected, and a spring washer 3294 may also be provided between the tube body 3291 and the cylinder tail 321), and the second PCB 3292 is electrically connected with the first PCB 322.

Embodiment 4

Figure 17:
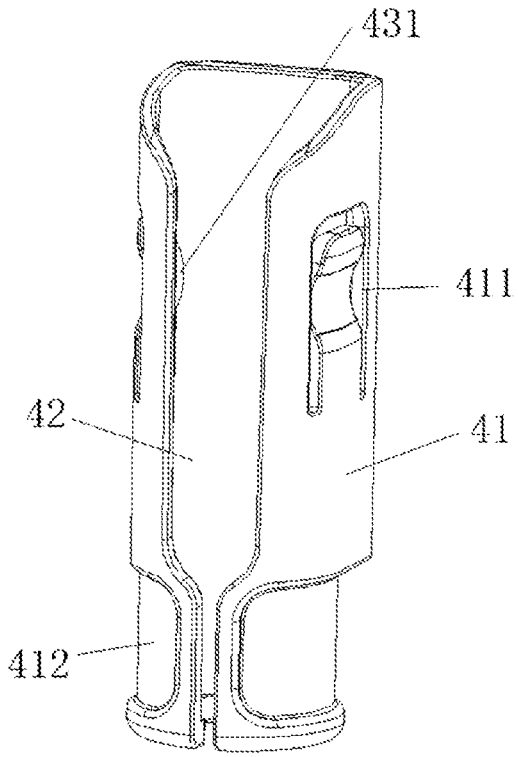
FIG. 17 is a three-dimensional structure diagram of a flashlight sleeve of Embodiment 4.
Figure 18:
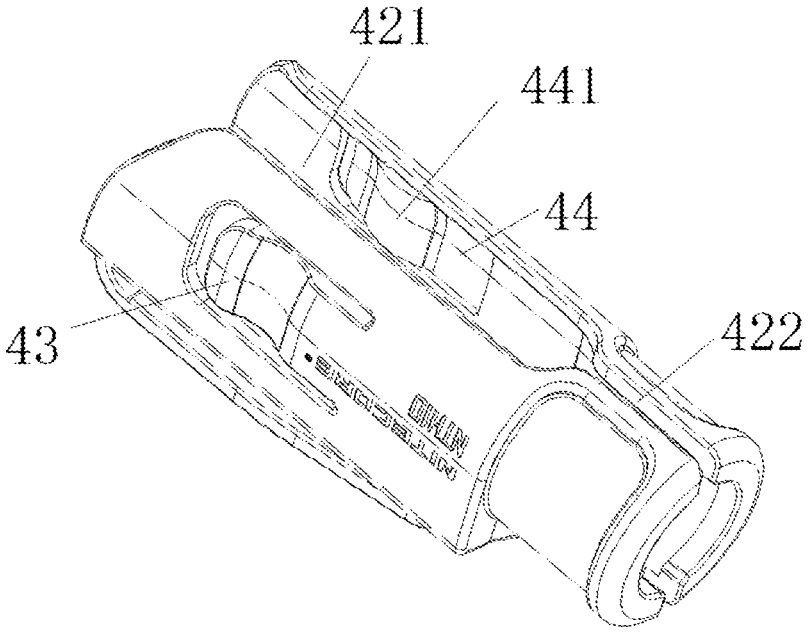
FIG. 18 is a three-dimensional structure diagram of the flashlight sleeve of Embodiment 4 at another viewing angle.
Figure 19:
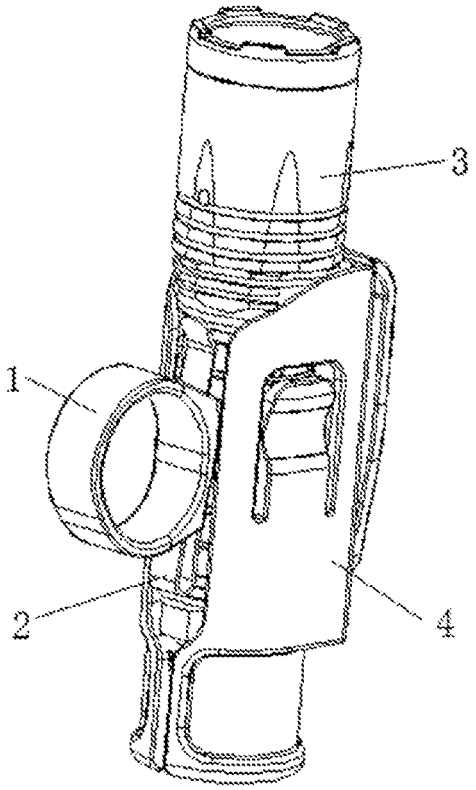
FIG. 19 is a three-dimensional structure diagram of the flashlight of Embodiment 4.

As shown in FIGS. 17-19, based on Embodiment 3, the flashlight of the embodiment further includes a flashlight sleeve 4 sleeved on the outer face of the flashlight body 3 and wrapping the same, the flashlight sleeve 4 includes a flashlight sleeve body 41, an opening part 42, and a first cantilever 43 and a second cantilever 44, which are arranged symmetrically, for clamping the flashlight body 3, wherein the opening part 42 is formed at the flashlight sleeve body 41 and extends in the up-down direction from the top to the bottom of the flashlight sleeve body 41. With the specific configuration of the flashlight sleeve 4, the flashlight can be compatible with the integrated ring clip of the invention.

Further, the flashlight sleeve body 41 can be provided with two fifth through holes 411, and the first cantilever 43 and the second cantilever 44 can be elastic sheets located in the two fifth through holes 411 respectively, and each includes a second protruding part 431, 441 protruding from the inner wall of the flashlight sleeve body 41 respectively, one ends of the first cantilever 43 and the second cantilever 44 being fixed to the flashlight sleeve body 41, and the other ends thereof being free ends. In this embodiment, the flashlight body 3 can be fastened by an elastic force of the first cantilever 43 and the second cantilever 44.

Further, in an embodiment, the flashlight sleeve body 41 includes a second groove 412 formed at a bottom position of the flashlight sleeve body 41 and extending along the circumferential direction of the outer face of the flashlight sleeve body 41. With the configuration of the second groove 412, it can serve as a gripping part of the flashlight for the user, and can also have an aesthetic effect. Of course, in other embodiments, the second groove may be not provided.

As a preferred embodiment, the opening part 42 can include a first opening part 421 and a second opening part 422 which are connected in the up-down direction, and the opening width of the first opening part 421 is greater than that of the second opening part 422. In this preferred embodiment, with the different opening widths of the first opening part 421 and the second opening part 422, the flashlight sleeve body 41 can be firmly locked and fixed to the flashlight body 3, and can also have the enough opening width to be compatible with the integrated ring clip of the invention, and the design is aesthetically pleasing.

In description of the invention, it needs to be understood that orientation or position relations denoted by the terms "center", "longitudinal", "transverse", "up", "down", "front", "rear", "left", "right", "vertical", "horizontal", "top", "bottom", "inner", "outer" and the like are orientation or position relations based on illustration in the drawings, and are only intended to facilitate describing the invention and simplifying description, instead of indicating or implying the denoted devices or elements necessarily have specific orientations or are constructed and operated in specific orientations, and thus they should not be understood as limiting the invention. In the description of the invention, the meaning of "plurality" is two or more, unless otherwise specified.

The foregoing embodiments only represent several implementations of the present invention, and are described concretely in detail, but should not be understood for this reason as limiting the patent scope of the present invention. It should be noted that for those of ordinary skill in the art, a number of modifications and improvements can be made without departing from the concept of the present invention, and all these modifications and improvements are encompassed within the protection scope of the present invention.

The invention claimed is:

1. An integrated ring clamp of a flashlight, comprising a ring and a clip, wherein the ring has a base; the clip comprises a clamping part and a holding part; the holding part is configured to hold and be fixed to a body of the flashlight; the holding part is fixed to the clamping part; and the clamping part is detachably fixed to the base, wherein the clamping part comprises a first clamping arm, a second clamping arm and a transition part; the first clamping arm and the second clamping arm are connected through the transition part; the first clamping arm is detachably fixed to the base; and the second clamping arm is fixed to the top of the holding part, and wherein the first clamping arm comprises an arm body and a buckle, the buckle is an elastic sheet with one end fixed to the arm body and the other end located above the arm body; a bottom face of the base is provided with a first clamping slot, running through in a front-rear direction, configured to clamp the first clamping arm, and a bottom face of the first clamping slot is provided with a second clamping slot for accommodating and clamping the buckle.

2. The integrated ring clamp of claim 1, wherein the arm body is provided with a through hole, and one end of the buckle is connected to an edge of the through hole, and the other end thereof is a free end located above the through hole.

3. The integrated ring clamp of claim 1, wherein the base comprises a left clamping part and a right clamping part, the left clamping part and the right clamping part each comprises a supporting part that can support the first clamping arm and limit the first clamping arm in a left-right direction, and a limiting part that can limit the first clamping part from moving backward, the supporting part and the limiting part are arranged successively in the front-rear direction; the second clamping slot is recessed obliquely forward from the bottom face of the first clamping slot, and has an oblique bottom face; and the oblique bottom face of the second clamping slot corresponds to the buckle of the first clamping arm.

4. The integrated ring clamp of claim 3, wherein each supporting part comprises a first side wall and a first support body horizontally extending inward from an end of the first side wall, and the supporting part of the left clamping part and the supporting part of the right clamping part enclose a T-shaped groove therebetween; each limiting part comprises a second support body and a limiting body, the second support body extending rearward from the first support body, and the limiting body extending upward from the second support body to the bottom face of the first clamping slot; the limiting part of the left clamping part and the limiting part of the right clamping part enclose a groove therebetween, an opening width of the groove is equal to an opening width of bottom of the T-shaped groove, and the T-shaped groove is communicated with the groove to form the first clamping slot.

5. The integrated ring clamp of claim 4, wherein the arm body of the first clamping arm is a flat and straight sheet, and comprises a base part and two first protruding parts, the first protruding parts are connected to two sides of the base part respectively and extend outward along a width direction of the base part; an rear end of each first protruding part abuts against one of the limiting bodies; and a maximum width of the arm body is greater than the opening width of bottom of the T-shaped groove, but not greater than a top width of the T-shaped groove.

6. The integrated ring clamp of claim 3, wherein the left clamping part and/or the right clamping part is also provided with an anti-collision groove.

7. The integrated ring clamp of claim 1, wherein the transition part is bent, and the second clamping arm is located just below the first clamping arm, and a clamping space is formed between the base of the ring and the second clamping arm.

8. The integrated ring clamp of claim 1, wherein the holding part is composed of two holding bodies located on a left side and a right side of the second clamping arm respectively, and each holding part is a bent elastic sheet.

9. A flashlight, comprising a flashlight body and the integrated ring clip of claim 1, wherein the flashlight body comprises a flashlight cylinder body, the flashlight cylinder body is provided with a connecting groove arranged on an outer face thereof around the flashlight cylinder body, and the holding part of the integrated ring clip holds and is fixed to the flashlight cylinder body and is limited within the connecting groove.

10. The flashlight of claim 9, wherein the arm body is provided with a through hole, and one end of the buckle is connected to an edge of the through hole, and the other end thereof is a free end located above the through hole.

11. The flashlight of claim 9, wherein the base comprises a left clamping part and a right clamping part, the left clamping part and the right clamping part each comprises a supporting part that can support the first clamping arm and limit the first clamping arm in a left-right direction, and a limiting part that can limit the first clamping part from moving backward, the supporting part and the limiting part are arranged successively in the front-rear direction; the second clamping slot is recessed obliquely forward from the bottom face of the first clamping slot, and has an oblique bottom face; and the oblique bottom face of the second clamping slot corresponds to the buckle of the first clamping arm.

12. The flashlight of claim 11, wherein each supporting part comprises a first side wall and a first support body horizontally extending inward from an end of the first side wall, and the supporting part of the left clamping part and the supporting part of the right clamping part enclose a T-shaped groove therebetween; each limiting part comprises a second support body and a limiting body, the second support body extending rearward from the first support body, and the limiting body extending upward from the second support body to the bottom face of the first clamping slot; the limiting part of the left clamping part and the limiting part of the right clamping part enclose a groove therebetween, an opening width of the groove is equal to an opening width of bottom of the T-shaped groove, and the T-shaped groove is communicated with the groove to form the first clamping slot.

13. The flashlight of claim 12, wherein the arm body of the first clamping arm is a flat and straight sheet, and comprises a base part and two first protruding parts, the first protruding parts are connected to two sides of the base part respectively and extend outward along a width direction of the base part; an rear end of each first protruding part abuts against one of the limiting bodies; and a maximum width of the arm body is greater than the opening width of bottom of the T-shaped groove, but not greater than a top width of the T-shaped groove.

14. The flashlight of claim 11, wherein the left clamping part and/or the right clamping part is also provided with an anti-collision groove.

15. The flashlight of claim 9, wherein the transition part is bent, and the second clamping arm is located just below the first clamping arm, and a clamping space is formed between the base of the ring and the second clamping arm.

16. The flashlight of claim 9, wherein the holding part is composed of two holding bodies located on a left side and a right side of the second clamping arm respectively, and each holding part is a bent elastic sheet.

17. The flashlight of claim 9, wherein the flashlight body further comprises a cylinder tail assembly, a battery and a cylinder head, the cylinder tail assembly comprises a cylinder tail, a first PCB, a tactical switch, a tact switch and a switch pressing plate; the cylinder tail comprises a cylinder wall and a cover that covers the top of the cylinder wall; the cover is step-like and formed by a first cover and a second cover connected from high to low; the second cover, the cylinder wall and the first cover enclose an accommodating cavity; the first cover is provided with a first through hole, and the second cover is provided with a second through hole; the first PCB is located inside the cylinder wall of the cylinder tail; the tactical switch and the tact switch are electrically connected and fixed to the first PCB respectively; the tactical switch passes through the first through hole and protrudes from the first cover; the tact switch passes through the second through hole and protrudes from the second cover, and is located within the accommodating cavity; the switch pressing plate is rotatably arranged above the tact switch, and a top face of the switch pressing plate is not higher than the first cover; and when the switch pressing plate is pressed, the tact switch is triggered.

18. The flashlight of claim 17, wherein the flashlight body also comprises a switch bracket and a silicone button cover; the tact switch comprises a switch part and a button part; the switch part of the tact switch is electrically connected and fixed to the first PCB, and the button part is located above the switch part; the switch bracket is provided with a third through hole and a fourth through hole; the switch bracket is sleeved on the first PCB; the tactical switch passes through the third through hole and the first through hole successively and protrudes from the first cover; the button part of the tact switch passes through the fourth through hole and the second through hole successively, protrudes from the second cover, and is located within the accommodating cavity; the silicone button cover comprises a silicone button cap located above the tactical switch and a silicone button cap located above the button part of the tact switch; the silicone button cap above the tactical switch passes through the first through hole and protrudes from the first cover; the silicone button cap above the tact switch passes through the second through hole, protrudes from the second cover, and is located within the accommodating cavity; and the switch pressing plate is rotatably arranged above the silicone button cap above the tact switch.

19. The flashlight of claim 17, wherein the cylinder tail assembly also comprises a cylinder tail adapter tube, and the cylinder tail adapter tube comprises a tube body, a second PCB fixed to the interior of the tube body, and a spring connected to the bottom of the second PCB, wherein the tube body is connected to a lower side of the cylinder tail, and the second PCB is electrically connected with the first PCB.

20. The flashlight of claim 9, further comprising a flashlight sleeve sleeved on an outer face of the flashlight body and wrapping the same, wherein the flashlight sleeve comprises a flashlight sleeve body, an opening part, and a first cantilever and a second cantilever, the first cantilever and the second cantilever are arranged symmetrically, for clamping the flashlight body, the opening part is formed at the flashlight sleeve body and extends in an up-down direction from the top to the bottom of the flashlight sleeve body.

21. The flashlight of claim 20, wherein the flashlight sleeve body is provided with two fifth through holes, and the first cantilever and the second cantilever are elastic sheets located in the two fifth through holes respectively, and each comprises a second protruding part protruding from an inner wall of the flashlight sleeve body respectively, one ends of the first cantilever and the second cantilever are fixed to the flashlight sleeve body, and the other ends thereof are free ends.

22. The flashlight of claim 20, wherein the flashlight sleeve body comprises a second groove formed at a bottom position of the flashlight sleeve body and extending along a circumferential direction of an outer face of the flashlight sleeve body.

23. The flashlight of claim 20, wherein the opening part comprises a first opening part and a second opening part which are connected in the up-down direction, and an opening width of the first opening part is greater than an opening width of the second opening part.

* * * * *